US009797600B2

(12) United States Patent
Barels

(10) Patent No.: US 9,797,600 B2
(45) Date of Patent: Oct. 24, 2017

(54) WATER HEATING DEVICE AND METHOD FOR MEASURING A FLAME CURRENT IN A FLAME IN A WATER HEATING DEVICE

(75) Inventor: Harm Hendrik Barels, RB Eext (NL)

(73) Assignee: Intergas Heating Assets B.V., Coevorden (NL)

( * ) Notice: Subject to any disclaimer, the term of this patent is extended or adjusted under 35 U.S.C. 154(b) by 593 days.

(21) Appl. No.: 14/241,334

(22) PCT Filed: Aug. 28, 2012

(86) PCT No.: PCT/NL2012/050588
§ 371 (c)(1),
(2), (4) Date: Jul. 10, 2015

(87) PCT Pub. No.: WO2013/032324
PCT Pub. Date: Mar. 7, 2013

(65) Prior Publication Data

US 2016/0047547 A1 Feb. 18, 2016

(30) Foreign Application Priority Data

Aug. 29, 2011 (NL) ..... 2007310

(51) Int. Cl.
*F23N 5/12* (2006.01)
*F23N 1/00* (2006.01)
(Continued)

(52) U.S. Cl.
CPC ..... *F23N 5/123* (2013.01); *F23N 1/002* (2013.01); *F23N 5/143* (2013.01); *F23N 5/265* (2013.01);
(Continued)

(58) Field of Classification Search
CPC ..... F23N 1/002; F23N 5/123
(Continued)

(56) References Cited

U.S. PATENT DOCUMENTS 2,604,936 A * 7/1952 Kaehni ..... F23C 99/001 122/14.21
4,245,977 A * 1/1981 Morese ..... F23N 5/123 307/653

(Continued)

FOREIGN PATENT DOCUMENTS

| | | |
|---|---|---|
| JP | 56 074519 | 6/1981 |
| JP | 2004-301437 | 10/2004 |
| WO | 2010/094673 | 8/2010 |

OTHER PUBLICATIONS

International Search Report for Application No. PCT/NL2012/050588 dated Jan. 24, 2013.

*Primary Examiner* — Avinash Savani
(74) *Attorney, Agent, or Firm* — Patterson & Sheridan, L.L.P.

(57) ABSTRACT

The invention relates to a water heating device, comprising a burner (20) and a flame current measuring device (100) for measuring a flame current, which measuring device comprises two electrodes and a voltage source (14), wherein each of the poles (18, 19) of the voltage source is connected to one of the electrodes. The water heating device further comprises a heat exchanger (40) which is electrically insulated relative to the burner. The burner and the heat exchanger here form the electrodes of the flame current measuring device. The heat exchanger functioning as electrode can be earthed (41). The measured flame current can be used to determine the excess air factor of the combustion. The water heating device can further comprise an air/fuel controller for controlling the air/fuel ratio, wherein the air/fuel controller uses the determined excess air factor to control the air/fuel ratio. The invention also relates to a method for measuring a flame current in a flame.

7 Claims, 3 Drawing Sheets

(51) Int. Cl.
*F23N 5/14* (2006.01)
*F23N 5/26* (2006.01)
*F24H 9/20* (2006.01)

(52) U.S. Cl.
CPC ..... *F24H 9/2035* (2013.01); *F23N 2029/12* (2013.01); *F23N 2041/02* (2013.01); *F23N 2041/04* (2013.01); *F23N 2041/06* (2013.01); *F23N 2900/05005* (2013.01)

(58) Field of Classification Search
USPC ..... 431/12, 75, 25; 122/14.21
See application file for complete search history.

(56) References Cited

U.S. PATENT DOCUMENTS

| | | | | |
|---|---|---|---|---|
| 4,543,055 | A * | 9/1985 | Tilly | F23N 1/002 431/12 |
| 2002/0155405 | A1 * | 10/2002 | Casey | F23N 1/002 431/60 |
| 2010/0159408 | A1 | 6/2010 | Beilfuss | |

* cited by examiner

WATER HEATING DEVICE AND METHOD FOR MEASURING A FLAME CURRENT IN A FLAME IN A WATER HEATING DEVICE

The present invention relates to a water heating device comprising a burner and a flame current measuring device for measuring a flame current, which measuring device comprises two electrodes and a voltage source, wherein each of the poles of the voltage source is connected to one of the electrodes.

The invention also relates to a method for measuring a flame current in a flame in a water heating device.

Such a water heating device and method are known, for instance from WO 2010/094673 A1.

In water heating devices water is heated. This is usually done using combustion heat. Examples are oil or gas-fired boilers. During the combustion of the fuel oxygen is required which is usually extracted from the ambient air. In the case of a gaseous fuel, fuel and oxygen, or fuel and air, are usually premixed, after which the mixture is combusted. If there is too little oxygen in the mixture, incomplete combustion will then occur. Carbon monoxide (CO) and other substances are then released. Carbon monoxide is toxic and release thereof should therefore always be prevented. Combustion devices for domestic use are therefore always set such that excess oxygen is available, so that complete combustion is possible. The greater the excess oxygen becomes, the less efficient is the combustion since it requires more energy to mix the fuel and the air or oxygen, this without the combustion producing more energy, but mainly because the excess air is needlessly heated, part of this heat disappearing to the outside with the excess through the flue gas discharge. Combustion devices are therefore usually set so that excess oxygen is available, but this excess should not be too large. The measure of excess is represented by the excess air factor $\lambda$, also referred to as the $\lambda$-value. This factor represents the factor at which excess air is present relative to the minimum quantity required to (theoretically) achieve a complete combustion. Water heating devices are set in practice such that the excess air factor $\lambda$ lies roughly between 1.2 and 1.3.

In conventional water heating devices the excess air factor $\lambda$ is controlled mechanically by adjusting the gas block. In more modern water heating devices the excess air factor $\lambda$ is controlled electronically. Where the mechanical control is a feedforward control which is set by the manufacturer and/or during installation (and optionally thereafter during maintenance) by an engineer, the electronic control provides more possibility of a feedback control.

For the purpose of feedback control however, a measurement must be made to enable direct or indirect determination of the excess air factor $\lambda$. Use is made for this measurement of inter alia a flame current measurement. This measurement is already carried out in many water heating devices as part of the flame detection.

Combustion devices make use of the combustion of a fluid, whereby there is a risk of explosion hazard if a valve in the feed for the fluid is open while combustion is not taking place (any longer), for instance as a result of the flame being blown out. The space in which the combustion device is located will in that case fill with the combustible or explosive fluid, and the formation of a single spark can at that moment have disastrous consequences. In order to obviate or at least reduce this danger use is made of flame detection. The flame detection ensures that, if the flame is no longer detected, the open signal to the fuel valve is suppressed, whereby the fuel valve closes and there is no further supply of fuel.

A very common method of flame detection is by means of an ionization-based safety. This method makes use of a flame current measurement. Use is made of the fact that the heat of a flame ionizes gas molecules, for instance in the air.

FIG. 1 shows an example of such a flame current measurement 10. A mixture of a combustible gas and air flows out of a burner 20. In the flame 13 the gas is combusted with the oxygen from the air. An electrode 12 is arranged in or close to the flame 30. An alternating voltage source 14 is connected via a capacitor 16, or optionally a resistor, to electrode 12. The other pole of the alternating voltage source 14 is connected to the (conductive) heat exchanger 40. This creates an alternating electric field over flame 30. Due to the ionizing action of the flame there are charged particles present between electrode 12 and heat exchanger 40. A small current hereby flows between electrode 12 and heat exchanger 40. The conductivity resulting from the alternating electric field is however not the same in both directions.

FIG. 2 shows the electrical equivalent-circuit diagram of the flame in the flame current measurement of FIG. 1. Resistor 32 represents the leakage current component through the flame which is the same for both current directions, and resistor 36 represents the additional leakage current component in the direction in which the conductivity is greater. The leakage current component through resistor 32 is much smaller than the leakage current component through resistor 36. Diode 34 ensures that this component occurs in only one direction. The diode effect ensures that the alternating voltage between clamps 18 and 19 (so between electrode 12 and heat exchanger 40) acquires a direct voltage component. Capacitor 16 provides for the separation of the alternating voltage component and the direct voltage component. The direct voltage component can be measured over capacitor 16. As long as a flame 30 is present between electrode 12 and heat exchanger 40, the direct voltage component is present between clamps 18 and 19 and measurable over capacitor 16. So as long as the direct voltage component is detected, the ionization-based safety will leave the gas supply of burner 20 open. However, should the direct voltage component cease, the gas supply is then closed.

The extent of ionization by the flame does however also provide information about the completeness of the combustion in flame 30. If the excess air factor $\lambda$ is varied, at $\lambda=1$ a maximum is then recorded in the measured flame current. The flame current measurement can therefore also be used to determine the excess air factor $\lambda$. Using these data the excess air controller can then regulate the excess air factor $\lambda$.

The measured flame current does not however depend only on the excess air factor. The size of the flame, the distance of the flame to electrode 12 and to heat exchanger 40 and the condition of electrode 12 and heat exchanger 40 (for instance degree of soot formation, degree of corrosion and the like) and other factors also affect the measured flame current.

The above-mentioned document WO 2010/094673 A1 describes a burner provided with a system for flame detection and gas/air control by means of two or more measuring pins at different distances from the surface of the burner. The measuring pins are connected in parallel here and form a first electrode, while the burner forms a second electrode or mass. When a flame is burning a current is generated over one of the measuring pins or both measuring pins and the earth (the burner) which is measured in an electrical component and optionally amplified. The output signal from this component goes to a control circuit which controls the air supply and the gas supply to the burner.

The Japanese document JP 56-74519 describes a burner with a system for detecting extreme flames which occur in the case of incomplete combustion. This system is based on two electrodes, the one of which is formed by heat-absorbing fins at some distance from the burner, while the other electrode (mass) is formed by the burner. In the case of incomplete combustion the flame makes contact with the fins, whereby a direct current is generated. This direct current is supplied to a control circuit which eventually closes a solenoid valve, whereby the gas supply to the burner is interrupted and the flame extinguished. There is no mention here of a gas/air control, but only of switch-off of the burner.

Finally, a flame detection system is also described in the American patent publication US 2010/159408 with two electrodes which are supplied with an alternating voltage.

The object of the present invention is to provide a flame current measurement which is less dependent on the above stated influences.

According to a first aspect of the invention, this object is achieved in a water heating device of the above described type with a heat exchanger which is electrically insulated relative to the burner, wherein the burner and the heat exchanger form the electrodes of the flame current measuring device.

In contrast to the prior art, where in addition to the heat exchanger a special measuring pin is present as electrode of the flame current measuring device, this special measuring pin is omitted in the present invention. It is the burner which acts as "measuring pin". Owing to the size of the burner and the heat exchanger the flame current measurement is less sensitive to variations in the distance between the flame and the electrodes when compared to the sensitivity of the prior art flame current measurement to variations in the distance between the flame and the special measuring pin. Particularly in the case of water heating devices with a relatively large burner the flame current measurement becomes less dependent on the placing of the "electrode" relative to the flame owing to the large surface area of both the burner and heat exchanger. The burners in the water heating devices of applicant have a width varying between about 10 cm and 40 cm. The large surface area of the burner and the heat exchanger also results in a lesser sensitivity to deposits on the heat exchanger, for instance soot, than the sensitivity of the special measuring pin of the prior art. The burner is also always situated upstream relative to the flame, so that the burner has much less of a problem with soot deposition. The burner is further also cooled by the flowing gas mixture, while the prior art measuring pin is normally placed in the flame itself.

Because the flame current also depends on the temperature of the electrodes, the flame current measurement according to the invention is less dependent on the absolute temperature and also less dependent on temperature fluctuations, for instance as a result of the burner being switched on and off. The distance between burner and flame further no longer depends on variations during construction of the water heating device, since this distance is determined mainly by the outflow speed of the air/fuel mixture, and no longer by the position of the measuring pin relative to the burner.

A further advantage is that, due to the larger surface area of the electrodes, a greater flame current will also begin to flow. Where the flame current generated with the measuring pin (WO 2010/094673 or US 2010/159408) or the fins (JP 56-74915) according to the prior art is several microamperes, the flame current in the present invention is from hundreds to several thousand microamperes, for instance about 1000 μA. The flame current measurement hereby becomes less sensitive to interference, and less stringent requirements can be set for the preamplifier which amplifies the flame current to a usable value. There is also an enormous increase in the resolution. There is a great difference in the measured leakage current in the case of proper combustion (close to $\lambda=1$) and a combustion which is not properly adjusted ($\lambda<1$ or $\lambda$ much greater than 1), whereby a variation in the excess air factor can be readily detected.

Since the heat exchanger and the burner each acquire a different potential, they have to be mounted electrically insulated relative to each other. Typical potential differences for the electrodes of a flame current measurement vary from several tens of volts (for instance 30 V) to several hundred volts (for instance 230 V or 300 V).

It is usual to connect most non-current-carrying metal parts of a combustion device to a shared potential, for instance mass. In an embodiment of the water heating device according to the invention the burner or the heat exchanger is earthed.

A structurally simple embodiment is obtained when the heat exchanger is earthed. The burner can be electrically insulated from the surrounding construction in relatively simple manner, while this is practically not possible for the heat exchanger.

In a preferred embodiment of the water heating device the measured flame current is used to determine the excess air factor of the combustion. In a further embodiment this excess air factor determination is subsequently utilized as protection against a wrongly set combustion, i.e. an excess air factor $\lambda$ which is either less than 1 or much more than 1. In yet another embodiment the excess air factor determination is used for the purpose of an excess air factor control, so that the excess air factor is always held within a range just above $\lambda=1$.

In a further embodiment the water heating device further comprises an air/fuel controller for controlling the air/fuel ratio, wherein the air/fuel controller uses the determined excess air factor to control the air/fuel ratio. The air/fuel controller controls the ratio of the quantity of air and fuel that is mixed. In a further embodiment the air/fuel controller operates an electronically controlled gas block.

A further preferred embodiment of the water heating device according to the invention comprises an ionization-based safety for closing the fuel supply to the burner when no flame is present between the burner and heat exchanger, wherein the ionization-based safety comprises the flame current measuring device and determines on the basis of the measured flame current whether a flame is present. Owing to the greater sensitivity of the flame current measuring device according to the present invention to the extent of combustion in the flame and a lesser sensitivity to factors such as soot deposition on the electrodes and corrosion of the electrodes (and therefore a greater selectivity of the flame current measuring device), a more reliable ionization-based safety is obtained.

In a further embodiment of the water heating device the voltage source applies an alternating potential difference to the two electrodes and measures the flame current in both directions. It is not essential per se to use an alternating potential difference for a flame current measurement. However, an ionization-based safety is based on demonstrating the diode effect of a flame. In order in this case to be able to detect a difference between the flame currents in both directions, it is essential that current be measured in both directions and that the potential difference thus reverses.

The water heating device can comprise a geyser, boiler, central heating boiler, or combi-boiler.

In a further embodiment of the water heating device the burner is a pilot flame burner and the device comprises a main burner, wherein the main burner is ignited by the flame of the pilot flame burner.

According to a second aspect of the invention, a method is provided for measuring a flame current in a flame in a water heating device comprising a burner and a heat exchanger electrically insulated therefrom, the method comprising of: applying a potential difference between the burner and the heat exchanger; and measuring a current which begins to flow as a result of the applied potential difference.

In a variant of the method comprises the further step of connecting the burner or the heat exchanger to the earth potential before applying the potential difference therebetween.

The heat exchanger is preferably connected to the earth potential, and the burner is electrically insulated from the surrounding construction, particularly from the heat exchanger.

The method can further comprise the step of determining an excess air factor on the basis of the measured flame current.

In yet another variant of the method the burner is provided with a mixture of air and fuel in an air/fuel ratio, and the method further comprises the step of controlling the air/fuel ratio on the basis of the determined excess air factor.

When the applied potential difference is an alternating potential difference, the method can further comprise the steps of measuring the flame current in both directions, determining whether there is a flame present between the burner and heat exchanger by establishing that the flame currents measured in both directions are not substantially the same, and closing the fuel supply to the burner if there is no flame present between the burner and heat exchanger.

Further embodiments and advantages are described with reference to the figures, in which FIG. 1 shows schematically a prior art flame current measuring device;

Figure 1:
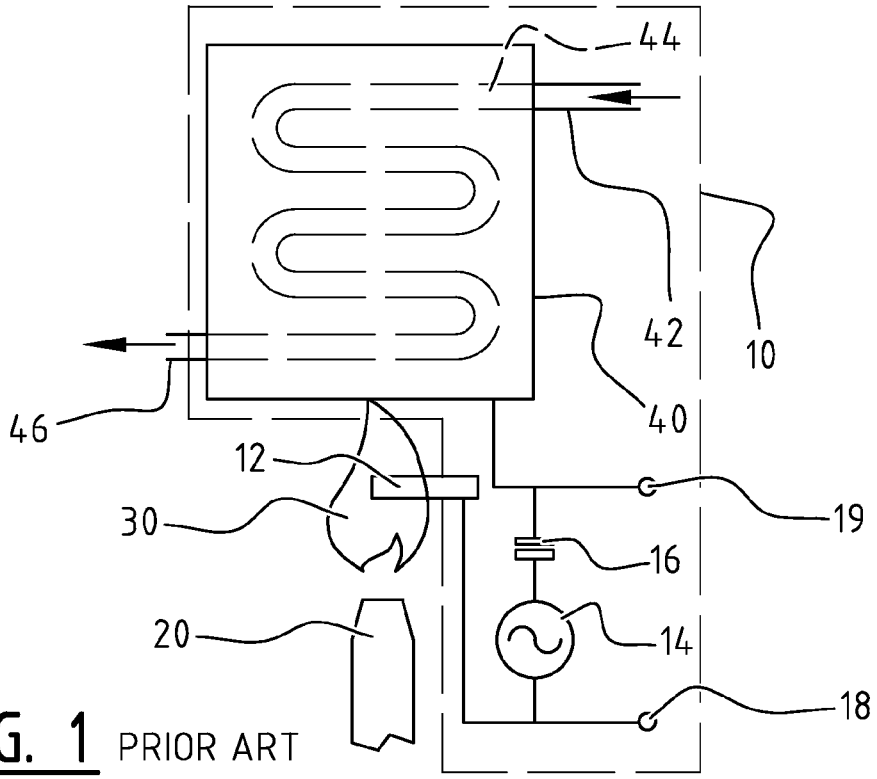
FIG. 1 PRIOR ART
Figure 2:
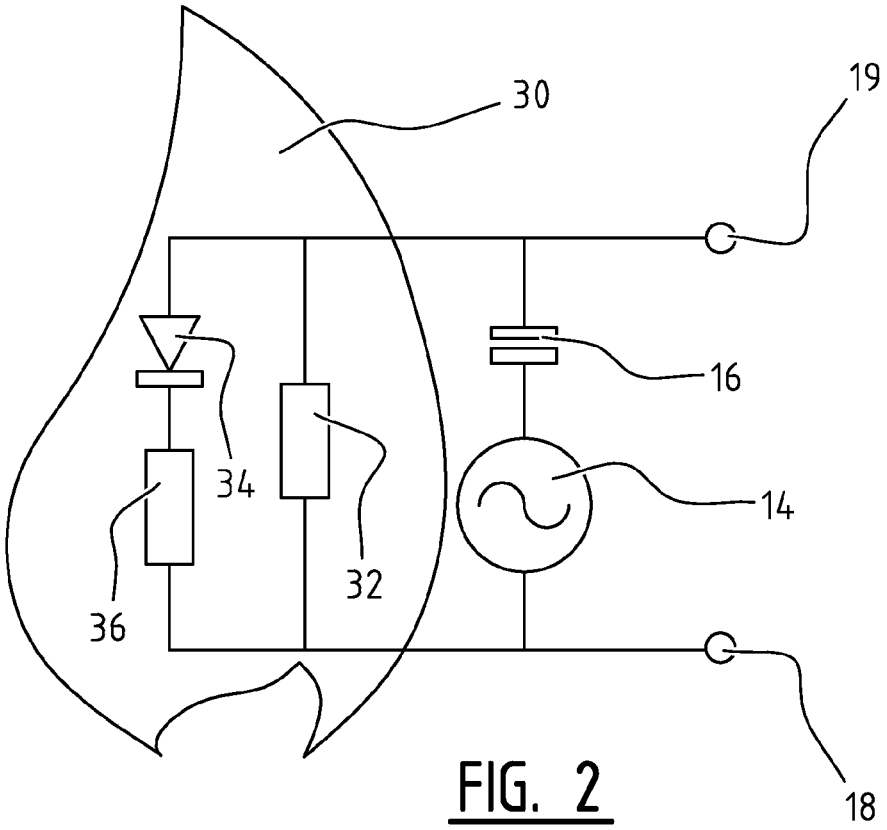
FIG. 2 shows an electrical equivalent-circuit diagram of the flame in the flame current measuring device of FIG. 1.
Figure 3:
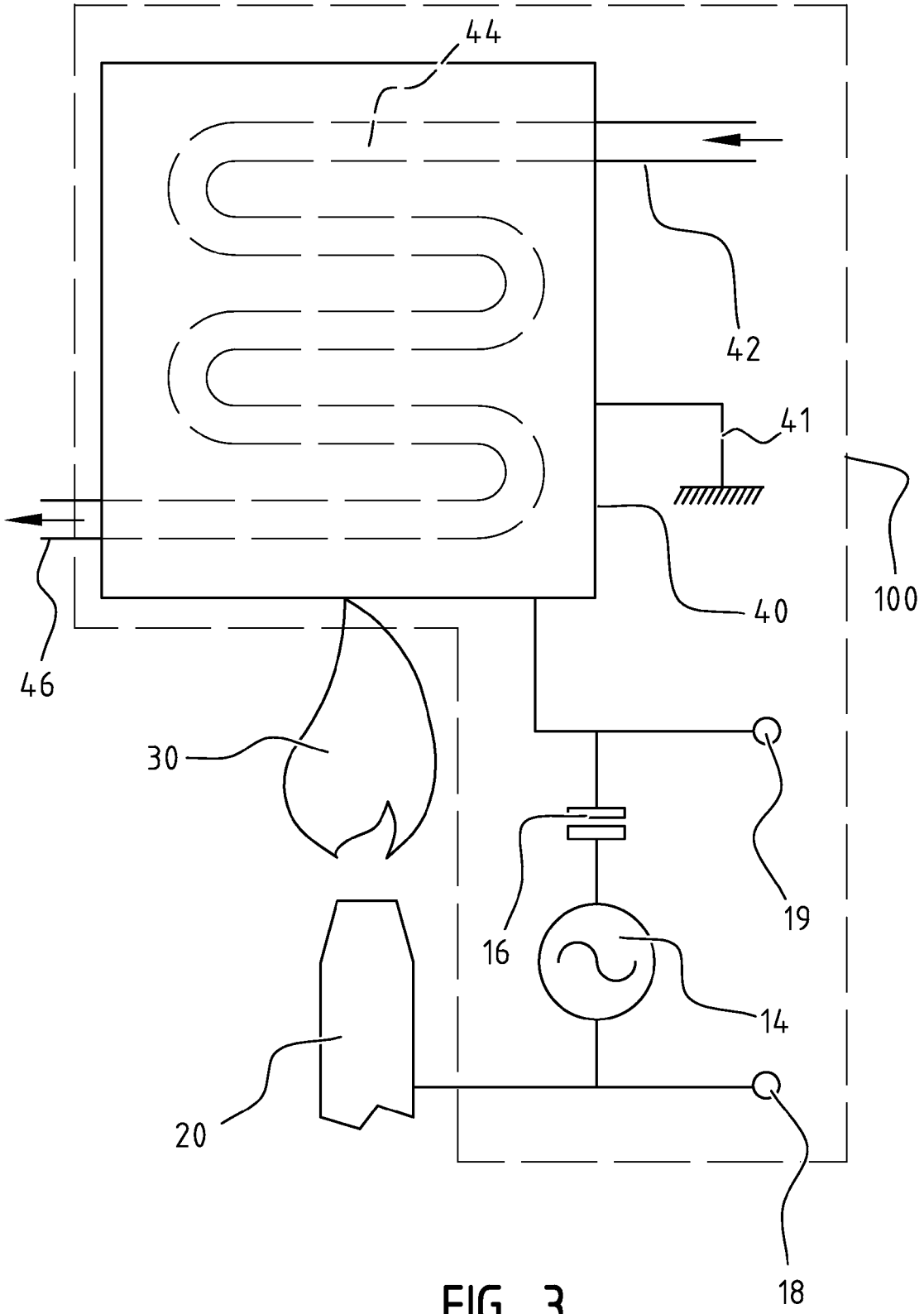
FIG. 3 shows schematically a flame current measuring device according to the present invention.

A preferred embodiment of the invention comprises a burner 20 and a heat exchanger 40. When an air/gas mixture flows out of the burner and the mixture is ignited, a flame 30 then burns. Owing to the combustion hot gases flow along heat exchanger 40 and relinquish their heat thereto. Heat exchanger 40 comprises a guide, for instance in the form of a tube 44, through which water flows. Cold water is supplied through a feed 42. Heat exchanger 40 relinquishes heat to the water in tube 44, whereby the water is heated. Hot water leaves heat exchanger 40 via discharge 46.

Burner 20 and heat exchanger 40, which are electrically insulated relative to each other, form the electrodes of a flame current measuring device 100. In the shown example heat exchanger 40—just as other non-current-carrying metal components of the water heating device—is connected to the earth potential via a line 41. Burner 20 on the other hand is electrically insulated from the surrounding construction, and particularly from heat exchanger 40. Both burner 20 and heat exchanger 40 comprise an electrically conductive material, for instance aluminium, copper or steel. Heat exchanger 40 comprises a material which is thermally conductive, for instance aluminium, copper or steel. The burner and the heat exchanger are each connected to a pole of a series connection of an alternating voltage source 14 and a capacitor 16. The alternating voltage source 14 ensures that an alternating electric field is created between burner 20 and heat exchanger 40. Capacitor 16 separates the alternating voltage component from the direct voltage component caused by flame 30.

Due to the heat of the combustion in the flame 30 a part of the gases in and around flame 30 ionizes. Under the influence of the electric field between burner 20 and heat exchanger 40 the charged particles will be displaced and a small leakage current will flow between the two electrodes, burner 20 and heat exchanger 40. The extent of this leakage current is determined by, among other factors, the completeness of the combustion, and thereby by the excess air factor $\lambda$. The excess air factor $\lambda$ is determined on the basis of the measured flame current.

Because the alternating voltage source 14 generates an alternating voltage, the electric field is alternating and the leakage current is likewise alternating. The leakage currents are not the same in both directions. The consequence is that over the series connection of the alternating voltage source 14 and capacitor 16 there is an alternating voltage on clamps 18 and 19 which has a direct current offset. (The flame itself additionally also functions to some extent as a weak voltage source.) This direct current component can be measured over capacitor 16. As soon as a direct current component is detected over these clamps, this means that a flame is burning between burner 20 and heat exchanger 40. The signal at clamps 18 and 19 is transmitted to a conventional circuit (not shown here) for ionization-based safety, wherein a comparator looks at whether the direct current component rises above a threshold voltage. If this is the case, then flame 30 is still burning and the valve in the gas feed may remain open. As soon as the comparator determines that the direct current component falls below the threshold value, the valve is no longer actuated, closes and the gas feed is shut off.

In addition, the signal at clamps 18, 19 is used to control the gas/air ratio of burner 20. As stated, the flame current represents an indication of the completeness of the combustion, and thereby of the excess air factor $\lambda$. The excess air factor $\lambda$ can thus be determined on the basis of the signal detected at clamps 18, 19, after which an air/fuel controller (not shown here) connected to clamps 18, 19 compares the thus determined factor $\lambda$ to a desired value of the excess air factor. On the basis of this comparison the fuel supply and/or the air supply is then controlled so as to set a desired air/fuel ratio. In practice the air/fuel controller intervenes in the fuel supply by operating the gas block.

Figure 4:
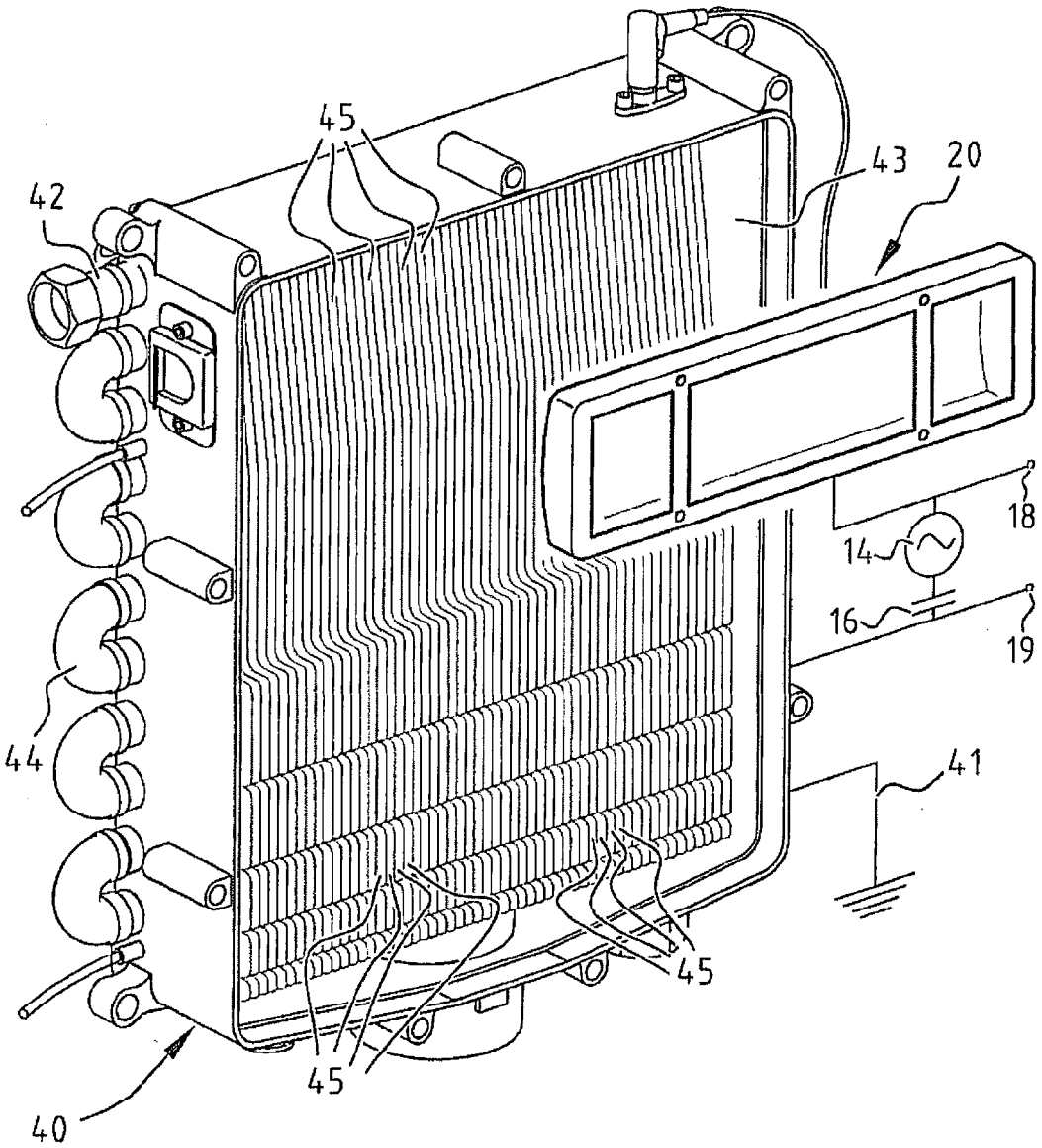
FIG. 4 shows a perspective view with exploded parts of a water heating device with a flame current measuring device according to the invention.

FIG. 4 shows a practical embodiment of a water heating device according to the invention. The distance between burner 20 and heat exchanger 40 is highly exaggerated here; in reality burner 20 is located close to the heat exchanger in a recessed space 43 formed by having the fins 45 of heat exchanger 40 protrude relatively less far outward. Shown clearly in the figure is that burner 20 has a relatively large surface area and extends over substantially the whole width of heat exchanger 40. A large flame current is hereby generated, so that a strong signal will thus be present at clamps 18, 19. This provides for a reliable flame detection and stable control of the gas/air ratio. The detection is in this way also less sensitive to an exact correct placing of the "electrodes" than in the case of a measuring pin. In addition, the sensitivity to ambient influences, for instance soot deposition, is greatly decreased due to the large surface area of the burner 20 functioning as electrode.

The embodiments described above and shown in the drawings are only exemplary embodiments by way of illustration of the present invention. Many modifications to and combinations of the shown and described exemplary embodiments are possible within the invention. The exemplary embodiments must not therefore be interpreted as being limitative. The protection sought is defined solely by the following claims.

The invention claimed is:

1. Water heating device, comprising: a burner, a flame current measuring device for measuring flame current to determine the excess air factor of the combustion, which measuring device comprises two electrodes and a voltage source, wherein each of the poles of the voltage source is connected to one of the electrodes, a heat exchanger which is electrically insulated relative to the burner, wherein the burner and the heat exchanger form the electrodes of the flame current measuring device, and characterized by an air/fuel controller for controlling the air/fuel ratio, wherein the air/fuel controller uses the determined excess air factor to control the air/fuel ratio.

2. Water heating device as claimed in claim 1, characterized by an ionization-based safety for closing the fuel supply to the burner when no flame is present between the burner and heat exchanger, wherein the ionization-based safety comprises the flame current measuring device and determines on the basis of the measured flame current whether a flame is present.

3. Water heating device as claimed in claim 1, characterized in that the voltage source applies an alternating potential difference to the two electrodes and measures the flame current in both directions.

4. Method for measuring a flame current in a flame in a water heating device comprising a burner and a heat exchanger electrically insulated therefrom, the method comprising of: applying a potential difference between the burner and the heat exchanger, and measuring a current which begins to flow as a result of the applied potential difference, characterized in that the heat exchanger is connected to the earth potential.

5. Method as claimed in claim 4, characterized by the step of determining an excess air factor on the basis of the measured flame current.

6. Method as claimed in claim 5, characterized in that the burner is provided with a mixture of air and fuel in an air/fuel ratio, and the method further comprises the step of controlling the air/fuel ratio on the basis of the determined excess air factor.

7. Method as claimed in claim 4, characterized in that the applied potential difference is an alternating potential difference, and the method further comprise the steps of: measuring the flame current in both directions; determining whether there is a flame present between the burner and the heat exchanger by establishing that the flame currents measured in both directions are not substantially the same; and closing the fuel supply to the burner if there is no flame present between the burner and heat exchanger.

* * * * *